United States Patent [19]

Kemmerer

[11] Patent Number: 4,592,279

[45] Date of Patent: Jun. 3, 1986

[54] SHEET GRIPPER FOR A PRINTING MACHINE

[75] Inventor: Klemens Kemmerer, Seligenstadt, Fed. Rep. of Germany

[73] Assignee: M.A.N.-Roland Druckmaschinen Aktiengesellschaft, Offenbach am Main, Fed. Rep. of Germany

[21] Appl. No.: 701,933

[22] Filed: Feb. 15, 1985

[30] Foreign Application Priority Data

Feb. 18, 1984 [DE] Fed. Rep. of Germany ... 8404981[U]

[51] Int. Cl.[4] ..... B41F 21/00

[52] U.S. Cl. ..... 101/412; 101/232; 101/409; 198/803.7; 271/82; 271/277; 294/99.2; 403/344; 403/386; 403/389

[58] Field of Search ..... 101/408, 409, 415.1, 101/410, 411, 412, 246, 232, 242; 271/277, 82, 85, 204; 198/803.7; 294/99.2

[56] References Cited

U.S. PATENT DOCUMENTS

| | | | |
|---|---|---|---|
| 1,542,734 | 6/1925 | Sherfy | 101/408 |
| 1,564,309 | 12/1925 | Harrold | 101/408 X |
| 2,418,065 | 3/1947 | Bobst | 101/408 X |
| 4,058,307 | 11/1977 | Bubley et al. | 101/408 X |
| 4,402,266 | 9/1983 | Sugiyama | 101/409 |

FOREIGN PATENT DOCUMENTS

| | | | |
|---|---|---|---|
| 1047212 | 12/1958 | Fed. Rep. of Germany | 101/408 |
| 1052414 | 3/1959 | Fed. Rep. of Germany | 101/408 |

*Primary Examiner*—Edgar S. Burr
*Assistant Examiner*—Moshe I. Cohen
*Attorney, Agent, or Firm*—Leydig, Voit & Mayer, Ltd.

[57] ABSTRACT

A sheet gripper for the delivery system of a printing machine or the like includes a clamp member adapted to be secured on a pivotable gripper shaft, and a gripper finger mounted resiliently on the clamp member and adapted to be brought into contact with a sheet to be gripped during pivoting of the gripper shaft. The clamp member is made of two sheet-metal parts and includes a base member and a bottom part, which are adapted to be hooked into engagement with one another on one side of the shaft and connected together by a mounting screw on the other side of the shaft to secure the clamp member on the gripper shaft. The gripper finger is also secured on the base member at one end by means of the mounting screw and is adjustable by means of a set screw threadably received in the base member approximately at the other end thereof. The gripper finger is made of spring steel and is pre-stressed to a specific spring force by means of a dimensioned recess and has a guide slot formed therein in which a lug formed on the base member is disposed to guide the gripper finger relative to the base member.

5 Claims, 4 Drawing Figures

SHEET GRIPPER FOR A PRINTING MACHINE

FIELD OF THE INVENTION

The present invention relates generally to sheet grippers for printing machines and more particularly concerns a gripper finger which is disposed resiliently with respect to a clamp member supported for pivotal movement on a gripper shaft.

BACKGROUND OF THE INVENTION

Known gripper constructions usually have a clamp member adapted to be secured on a pivotal gripper shaft in a predetermined position and the sheet gripper is usually mounted and guided resiliently on the clamp member with the sheet gripper spring force acting from the clamp member relative to a sheet gripper stop. The clamp member of the known sheet grippers, however, is generally expensive and complex to manufacture because of the adaptor required for the drive shaft. Usually, the sheet grippers can be removed only when the gripper shaft is removed from the printing machine. This removal of the gripper shaft requires considerable time and leads to particularly high costs for assembly or adjustment of the sheet grippers, particularly on a change thereof.

German utility model No. 6 608 544 discloses a sheet gripper which solves the problem of so constructing a gripper provided with pivoting levers that are rotatable with respect to stops which are stationary relative to the gripper holder, thus obviating the disadvantages of the known constructions. With respect to perfect register during sheet transfer, this gripper is also said to have advantages that were hitherto obtainable only with gripper arms of the kind in which the parts cooperating with the stops carry out a traversing movement with respect to the stops during closing and opening, without the disadvantages of a large travel during the gripper opening and closing movement.

OBJECTS AND SUMMARY OF THE INVENTION

The primary aim of the present invention is to provide a sheet gripper for a printing machine which is inexpensive to manufacture and is easily fitted and adjusted on a pivotal gripper shaft.

It is a more detailed object to provide a sheet gripper having a resilient gripper finger secured to a base member on the gripper shaft by a single mounting screw with a separate set screw being provided for adjusting the finger with respect to the base. As a result of securing the gripper finger by just one screw, the gripper finger can be rapidly fitted and rapidly adjusted after the base member has been secured on the drive shaft. The gripper finger is preferably made of spring steel and already prestressed by bending in the fitted state and is designed accurately to a specific spring force by means of a recess at the clamping point.

More specifically the sheet gripper is provided with a bottom part that is latchable on one side on the base member and is detachably secured on the gripper shaft by the mounting screw on the opposite side. The bottom part may be a simple stamping which is pre-bent in the proper form and the sheet gripper thus requires no expensive adaptor and is therefore very inexpensive and easy to manufacture.

Another desirable feature is that the special position of the mounting screw on the sheet gripper and the latchable bottom part enable the sheet gripper to be replaced without it being necessary to remove the gripper shaft from the printing machine. Rather, the sheet gripper together with the base member and the bottom part is simply fitted on the gripper shaft by one screw.

It is yet another object to provide a sheet gripper wherein assembly and adjustment are two different processes carried out with different screws in two different operations. For assembly the bottom part is engaged on one side on the base member and thus fitted on the gripper shaft. The mounting screw is then tightened and the sheet gripper is fitted on the gripper shaft. Accurate adjustment of the sheet gripper in respect of the gripper support force is carried out by a small additional set screw which is self-locking.

In the preferred embodiment, the gripper finger is guided on the base member by means of a lug during its spring movements. The lug is simply a projection from the base member which extends into a slot in the gripper finger.

A still further object of the invention is to provide a sheet gripper that requires no bearings on the gripper shaft which cannot therefore seize up due to dirt. Also, no protective caps are required to prevent the entry of dirt, because the sheet gripper is of a general design such as to require no expensive fitting means.

According to the invention, a sheet gripper for the delivery system of a printing machine or the like is provided including a clamp member adapted to be secured on a pivotable gripper shaft and a gripper finger mounted resiliently on the clamp member and adapted to be brought into contact with a sheet to be gripped during pivoting of the gripper shaft, characterized in that the clamp member is made in two sheet-metal parts and includes a base member and a bottom part which are adapted to be hooked into engagement with one another on one side of the shaft and connected together by a mounting screw on the other side of the shaft to secure the clamp member on the gripper shaft, the gripper finger also being secured on the base member at one end by means of the mounting screw and being adjustable by means of a set screw threadably received in the base member approximately at the other end thereof.

Preferably, the gripper finger is made of spring steel and is pre-stressed to a specific spring force by means of a dimensioned recess. The gripper finger is also desirably formed with a guide slot in which a lug formed on the base member is disposed to guide the gripper finger relative to the base members. A set screw is also disposed in the base member beneath the guide slot so that the set screw is adjustable by means of a hexagonal Allen wrench inserted through the slot.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a fragmentary plan view of three sheet grippers of the present invention mounted on a pivotal gripper shaft of a printing machine or the like;

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
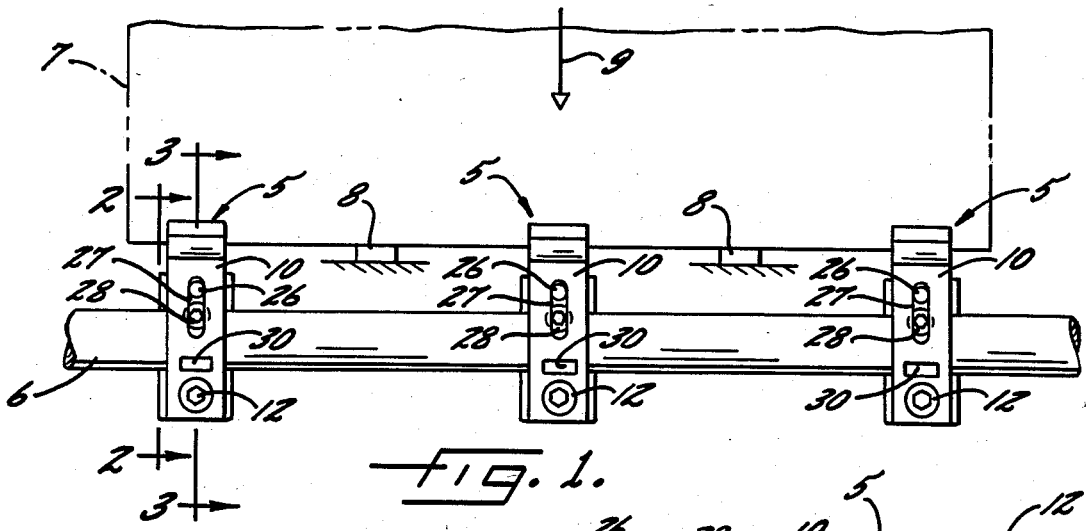

Turning now to the drawings, there are shown in FIG. 1 a plurality of sheet grippers 5 mounted on a shaft 6 of a printing machine or the like. The grippers 5 are adapted to receive and pick up a sheet 7 being transported by the delivery system of the press as the leading edge of the sheet 7 abuts suitable stops 8. It will be understood that the gripper shaft 6 is mounted in suitable bearings in the press frame (not shown) and the shaft 6 is rotatable so as to bring the sheet grippers 5 into engagement with the sheets 7 moving in the direction of arrow 9.

Figure 2:
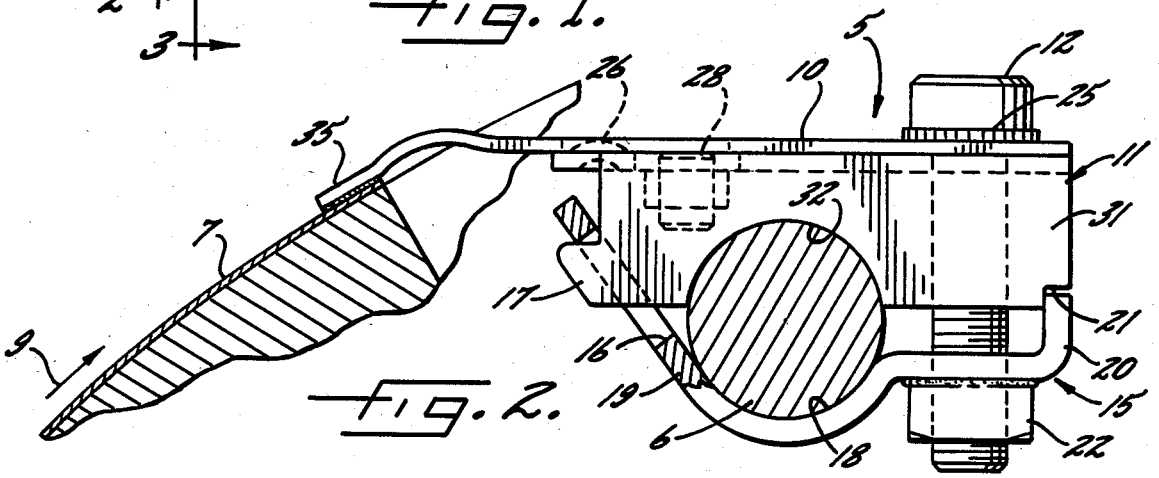
FIGS. 2 and 3 are enlarged sectional views of the sheet gripper in FIG. 1 taken substantially along the lines 2—2 and 3—3, respectively.
Figure 3:
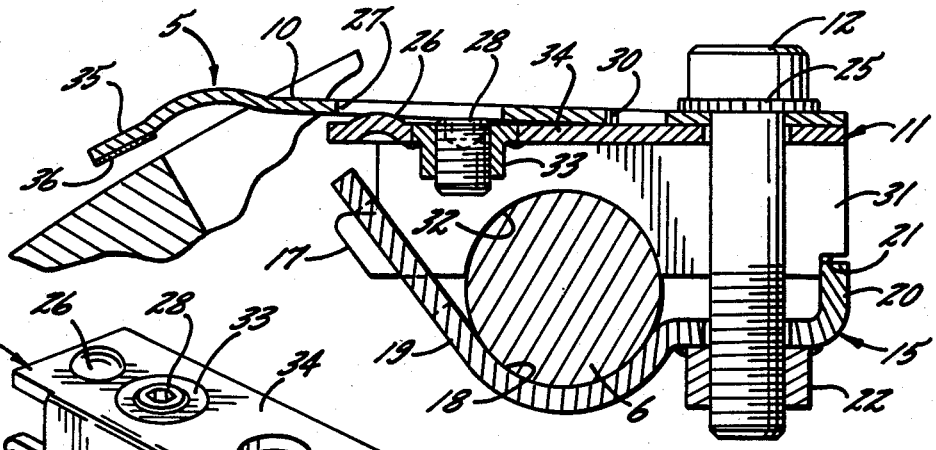

As shown in FIGS. 2 and 3 the gripper 5 includes a gripper finger 10 secured to a base member 11 by a mounting screw 12. The mounting screw 12 also secures a bottom part 15 of the sheet gripper 5 to the base member 11 in addition to the gripper finger 10. The gripper 5 is thus secured to the gripper shaft 6 of the delivery system of the press by means of a single mounting screw 12. Accordingly, the sheet gripper 5 can be readily fitted to and removed from the shaft 6 without the gripper shaft having to be removed from the printing machine.

During fitting of the sheet gripper 5 on the shaft 6 the bottom part 15 is hooked in engagement with the base member 11 by a pair of recesses 16 which receive a pair of projecting ears 17 on the base member 11. The bottom part 15 is preferably formed with a concave portion 18 which partially surrounds the grippers shaft 6 and a tangential end portion 19 in which the recesses 16 are located. At its other end, the bottom part 15 is formed with a flange 20 which fits in a groove 21 formed in the base member 11. Thus, the bottom part 15 and the base member 11 form a two-part clamp for mounting the gripper 5 on the gripper shaft 6 even though the shaft may have differing diameters. In the preferred embodiment, the mounting screw 12 is screwed into a suitable nut 22 welded to the underside of the bottom part 15.

In accordance with the present invention, practically the entire length of the gripper finger 10 lies flatly on the base member 11 and the gripper finger is secured to the base member 11 at one end by means of the screw 12. To secure the screw 12, a knurled washer 25 is provided between the head of the screw 12 and the gripper finger 10. The gripper finger 10 can deflect resiliently over its entire length from the screw 12 to the bent end of the gripper support.

To guide the gripper finger 10 during deflection when the sheet gripper 5 is in operation, a lug 26 is provided on the base member 11 and projects into a longitudinal slot 27 in the gripper finger 10. During operation, the gripper finger 10 can perform the necessary spring movements over its entire length, during which the lug 26 guides the gripper finger 10 on the base member 11.

Pursuant to another aspect of the invention, each of the sheet grippers 5 is secured on the gripper shaft 6 by a single mounting screw 12. However, the gripper fingers 10 are individually adjusted by means of adjusting screws 28, depending on the retaining force required for the particular sheet. Thus the gripper finger 10 may be finely adjusted according to printing conditions and in accordance with the printer's experience. These fine adjustments can be carried out very rapidly with the self-locking adjusting screw 28, since it is readily accessible from above through the slot 27 by means of a hexagonal Allen wtench or the like. The width of the slot 27 is for this purpose made somewhat larger than the maximum outside dimensions of the Allen wrench.

In accordance with the invention, means are provided for predetermining the spring force of the resilient gripper finger 10 which is preferably made of spring steel stock. As shown in FIG. 1 each of the fingers 10 is formed with a dimensioned recess 30 located adjacent the mounting bolt 12. The recess 30 is rectangular in shape and its longitudinal side is situated transversely of the longitudinal side of the gripper finger 10. It will be understood that the width and length of the recess 30 defines the resilient prestressing force of the gripper finger 10.

In the preferred embodiment the guide slot 27 is disposed substantially in the middle of the spring travel of the gripper finger 10 on the centerline of the base member 11. This specific position allows accurate fine adjustment of the sheet gripper 5. The easy and simple form of construction of the sheet gripper 5 without any adaptor on the gripper shaft 6 obviates the need for additional protective caps. Also, there are as a result no bearings on the drive shaft which might cause the sheet gripper 5 to seize up on the gripper shaft 6 due to soiling.

Figure 4:
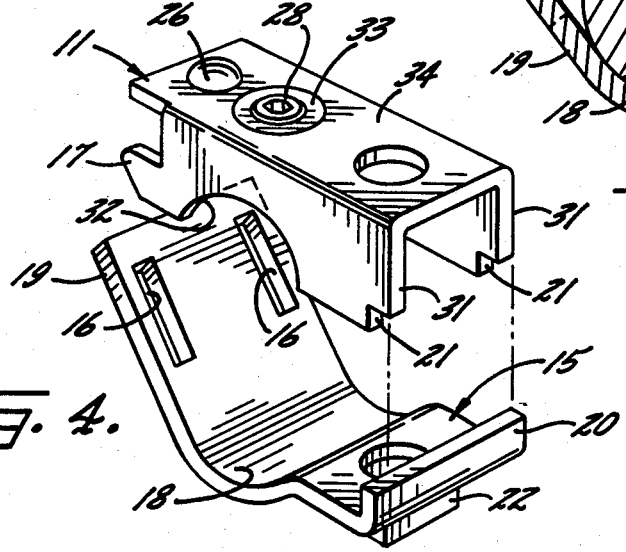
FIG. 4 is an exploded isometric view of the base member and bottom part which together form the clamp of the sheet gripper shown in FIGS. 1-3.

As shown in FIG. 4, the gripper clamp is made of two sheet-metal parts including the base 11 and the bottom part 15. The base 11 is preferably pre-bent in a substantially inverted U-shape with depending sides 31 formed with semi-circular or arcuate recess 32 to engage the shaft 6. A threaded socket 33 is welded in an opening in the back portion 34 of the base 11. The free end 35 of the gripper finger 10 is provided with a strip of adhesive material 36 on its underside to facilitate gripping of the sheet 7. Also it is desirable to prestress the gripper finger 10 by bending it about 5° with respect to the back portion 34 of the base 11.

I claim as my invention:

1. A sheet gripper for the delivery system of a printing machine or the like, comprising, in combination, a clamp member adapted to be secured on a pivotable gripper shaft, and a gripper finger mounted resiliently on the clamp member and adapted to be brought into contact with a sheet to be gripped during pivoting of the gripper shaft, said clamp member being made in two sheet-metal parts and includes a base member and a bottom part, which are adapted to be hooked into engagement with one another on one side of the shaft and connected together by a mounting screw on the other side of the shaft to secure the clamp member on the gripper shaft, the gripper finger also being secured on the base member at one end by means of the mounting screw and being adjustable by means of a set screw threadably received in the base member approximately at the other end thereof, said base member being generally inverted U-shaped having depending side walls formed with substantially semi-circular recess therein for engaging the gripper shaft, said side walls having a pair of projecting ears and said bottom part being formed with a generally concave portion to match the gripper shaft on the other side of the mounting screw and projecting tangentially out of the concave portion and having a pair of recesses adjacent the tangential end to receive said pair of projecting ears on the side walls of the base member thereby affecting engagement with the base member, and said gripper finger being made of spring steel and pre-stressed by means of a transverse rectangular recess of predetermined size between the mounting screw and the set screw.

2. A sheet gripper according to claim 1, characterized in that the gripper finger has a guide slot formed therein in which a lug formed on the base member is disposed to guide the gripper finger relative to the base member.

3. A sheet gripper according to claim 2, characterized in that the set screw is disposed in the base member beneath the guide slot so that the set screw is adjustable by means of a hexagonal Allen wrench inserted through the slot and thus the gripper finger is adjustable relative to the base member.

4. A sheet gripper according to claim 1 characterized in that a self-locking washer is provided between the head of the mounting screw and the gripper finger and a nut is welded to the underside of the sheet-metal bottom part.

5. A sheet gripper according to claim 1, characterized in that the gripper finger is shaped to cooperate with the delivery system and is constructed with an adhesive material on the under surface of the face end thereof.

* * * * *